US006228443B1

(12) United States Patent
Ditto et al.

(10) Patent No.: US 6,228,443 B1
(45) Date of Patent: May 8, 2001

(54) MINIATURE MODEL TREES AND METHOD OF MANUFACTURING

(75) Inventors: Andrew A. Ditto; Chris M. King; Joseph P. Buhecker; Kevin R. Minix, all of Salt Lake City, UT (US)

(73) Assignee: Grand Central Gems, Salt Lake City, UT (US)

( * ) Notice: Subject to any disclaimer, the term of this patent is extended or adjusted under 35 U.S.C. 154(b) by 0 days.

(21) Appl. No.: 09/440,735

(22) Filed: Nov. 16, 1999

Related U.S. Application Data

(60) Provisional application No. 60/108,757, filed on Nov. 17, 1998.

(51) Int. Cl.[7] ..... A47G 33/06

(52) U.S. Cl. ..... 428/18; 427/180; 427/202; 427/206; 140/149

(58) Field of Search ..... 427/202, 206, 427/180; 140/149; 428/18

(56) References Cited

U.S. PATENT DOCUMENTS 2,216,440 * 10/1940 Houle ..... 428/18

* cited by examiner

*Primary Examiner*—Alexander S. Thomas
(74) *Attorney, Agent, or Firm*—Pate Pierce & Baird

(57) ABSTRACT

A miniature model tree is provided that is random in appearance and durable in design. In embodiments disclosed herein, the miniature model tree comprises a plurality of twisted wires, spiraled together to simulate a trunk; a plurality of fibrous strands simulating branches wound within the twisted wire; a layer of paint over the branches; and fine particles layered over the layer of paint and attached to the branches by the layer of paint to simulate foliage. A hardening layer may be provided over the foliage. A method of making miniature model trees comprises placing a plurality of fibrous strands within a plurality of wires with the strands protruding substantially laterally outward from the plurality of wires; forming a trunk by twisting the plurality of wires together such that the fibrous strands become substantially dispersed within the wires; adhering a layer of paint to the branches; adhering a coating of fine particles to the branches while the paint is still wet; adding a hardening coating over the branches; and wrapping the bottom of the trunk in an adhesive tape.

13 Claims, 4 Drawing Sheets

MINIATURE MODEL TREES AND METHOD OF MANUFACTURING

RELATED INVENTIONS

This application is a Continuation-In-Part of and claims priority to U.S. Provisional patent application Ser. No. 60/108,757, filed on Nov.17, 1998 and entitled Miniature Model Trees and Method of Manufacture.

BACKGROUND OF THE INVENTION

1. Field of the Invention

The present invention relates to miniature model trees and their methods of manufacture. More specifically, the present invention relates to an improved miniature model tree which is constructed to be highly life-like and durable.

2. The Relevant Technology

The hobby of modeling has been with us practically from the beginning of time. In ancient times, models were often constructed to reflect dwellings, transportation mediums such as boats, and military units. Modeling today is as diverse as our society. Particular favorites include model trains, airplanes, and automobiles. Modeling is also used extensively in industry. For instance, architects often use models in the designing of buildings and landscapes.

Hobbyists have a wide range of interests, and their desire for accuracy varies greatly as well. To some modelers, realism is highly important. Even demanding hobbyists must consider economics, however. Extremely lifelike models and accessories are of no avail of they cannot be manufactured and distributed affordably. Thus, modeling products are generally mass produced and distributed in bulk. A further goal of manufacturers of such products is, necessarily, durability of use and durability in shipping.

One common aspect of contemporary modeling is scenery. Scenery may be used in all aspects of modeling, but is possibly most prominent in model railroads. Scenery and accessories for model railroads is a thriving industry in the United States. The model railroad hobbyist enjoys a wide range of available products from which to select.

Nevertheless, scenery products, as with other modeling products, must balance realism with price and longevity. These tradeoffs show up in the manufacture of miniature model trees. Currently, miniature model trees are mass produced in a manner that leads to each model tree looking the same as all other model trees produced in a common batch. This leads to a lack of realism in scenery designs employing such trees.

Additionally, in the manufacture of such model trees, foliage is flocked on the trees, much in the same way as simulated snow is flocked onto Christmas trees. This flocking is limited in its realism, because the flocking tends to stick to itself, rather than just to the underlying simulated branches. Additionally, foliage applied in this manner is easily knocked free from the tree. Accordingly, such trees are not especially durable.

Conventional model trees produced in this manner must be packaged with great care, in order to avoid damage and excessive loss of foliage. Such packaging is generally quite expensive.

Accordingly, a need exists in the art of miniature model tree making for a miniature model tree and method of manufacture that produces a more realistic model tree, and specifically, model trees that are not identical and have a randomness to their appearance. A method of making model trees with more realistic foliage is also needed. A need also exists for more durable miniature model trees, such that shipping costs can be reduced. Methods of making such model trees relatively inexpensively are also needed.

OBJECTS AND BRIEF SUMMARY OF THE INVENTION

The apparatus of the present invention has been developed in response to the present state of the art, and in particular, in response to the problems and needs in the art that have not yet been fully solved by currently available model trees. Thus, it is an overall objective of the present invention to provide a miniature model tree that overcomes many or all of the shortcomings existing in the art.

The apparatus of the present invention comprises a miniature model tree for use in creating and replicating scenery. In one embodiment, the miniature model tree comprises a plurality of twisted wires, spiraled together to simulate a trunk and a plurality of fibrous strands simulating branches, the fibrous strands wound within the twisted wire and extending outward from the twisted wire substantially perpendicular thereto. The miniature model tree also preferably comprises a layer of paint over the branches and a coating of fine particles over the layer of paint and attached to the branches by the layer of paint to simulate foliage.

The layer of paint may contains glue and may contain detergent. The fiber strands may comprise sisal strands preferably unwound from a rope. In certain embodiments, the miniature model tree may also comprise a hardening layer disposed over the fine particle layers. Preferably, the thickness of the branches and the dispersion of the branches are substantially arbitrarily selected.

A method of the present invention is used for making miniature model trees for use in creating and replicating scenery. In one embodiment, the method comprises suspending a plurality of wires substantially in tension, placing a plurality of fibrous strands within the plurality of wires with the strands protruding substantially laterally outward from the plurality of wires, and forming a trunk by twisting the plurality of wires together such that the wires form coils with the fibrous strands substantially dispersed within the coils, the edges of the fibrous strands extending outward from the coils to simulate branches.

Additionally, the method preferably comprises adhering a layer of paint to the fibrous strands and adhering a coating of fine particles to the branches while the paint is still wet. The fine particles may comprise model grass. The method may also comprise adhering a hardening layer over the coating of fine particles.

In certain embodiments, the method comprises adhering a layer of clear laquer to the branches prior to adhering a layer of paint to the fibrous strands. The method may also comprise mixing glue into the paint prior to adhering a layer of paint to the fibrous strands.

In certain embodiments, the wires are sufficiently long to form a plurality of model trees therefrom, and further comprising placing fibrous strands within the plurality of wires at a plurality of locations prior to the step of forming a trunk, so as to form a plurality of trees within the plurality of wires.

The method may also comprise placing the paint in the bottom of an elongated tube, and placing the plurality of wires within the elongated tube. The fine particles may likewise be contained within an elongated tube, and the step of adhering the coating of fine particles may be conducted with the plurality of wires extending through the center of the elongated tube.

The method also preferably comprises arbitrarily selecting the length of the fibrous strands and arbitrarily selecting the dispersion of the fibrous strands during the step of placing a plurality of fibrous strands within the wires and cutting a strand of hemp rope and unraveling the strand of hemp rope in order to provide the fibrous strands.

The layer of paint adhered to the branches may be substantially a brown shade and the fine particles may be substantially a green shade so as to give the miniature trees a random, two toned appearance. The method may also comprise wrapping a portion of the bottom of the trunk in an adhesive tape.

The method may also comprise providing a rotary power mill and clamping one end of the plurality of wires within the rotary power mill, the rotary power mill dynamically positioned so as to be able to move forward during the step of forming a trunk by twisting the plurality of wires together so as to maintain a substantially constant tension on the plurality of wires.

These and other objects, features, and advantages of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained will be readily understood, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
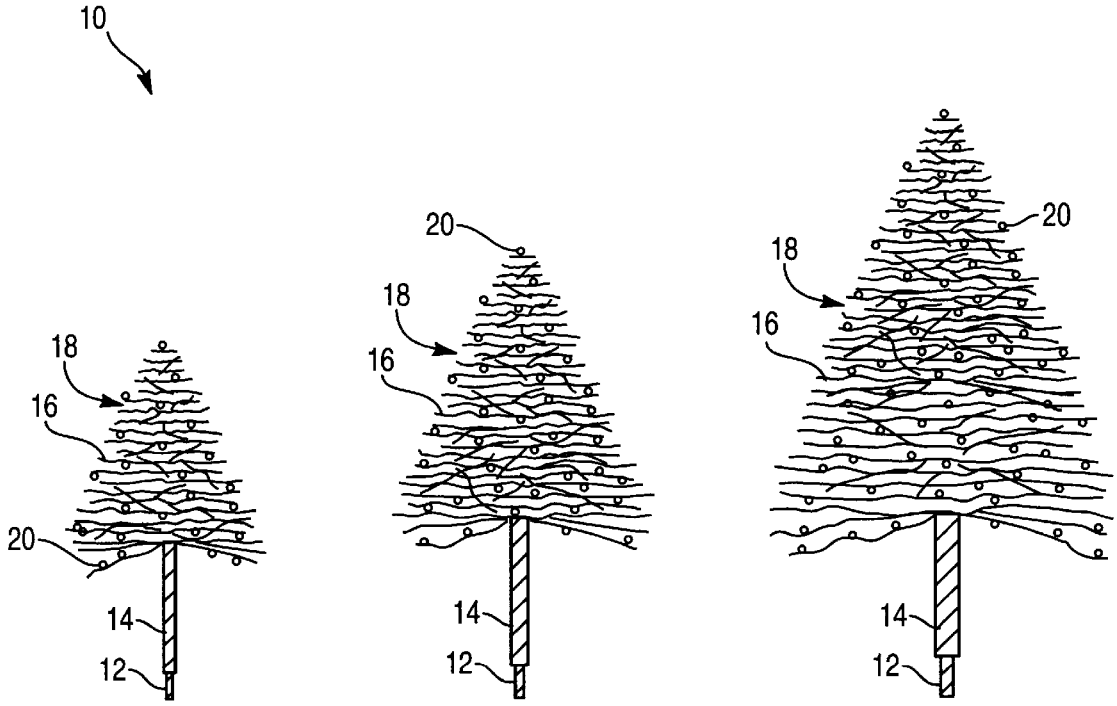
FIG. 1 is a perspective side view illustrating a plurality of randomly formed and sized miniature model trees of the present invention.

The present invention is directed to the fabrication and manufacture of miniature model trees. The miniature model trees are designed to be useful in replicating scenery, such as in architect's models and miniature train modeling. In one aspect, the present invention comprises a method of manufacturing the miniature model trees. The present invention is also directed to the unique qualities of the trees formed with the inventive method. One embodiment of the miniature model trees is shown in FIG. 1. The method of manufacturing is shown in one embodiment in FIGS. 2 through 7.

Referring to FIG. 1, the miniature model trees 10 are shown as comprising a wire core 12. The wire core in one embodiment comprises two wires substantially twisted into coils that spiral around each other. Preferably the coils are uniform to form a continuous uniform spiral shape in each wire and such that the two wires together are substantially linear and generally uniform. Around the base of the wire core 12 is wrapped an adhesive tape 14 such as florist's tape. The florist's tape is preferably brown in color to resemble a tree trunk.

Emanating from the wire core 12 are fibrous strands 16. The fibrous strands 16 are preferably strands of sisal or hemp, and more preferably, are separate strands of sisal or hemp rope. In one embodiment, the strands are unwound from a rope prior to being incorporated into the miniature model trees 10.

The centers of each of the fibrous strands 16 are intertwined within the coils of the wire core 12. The two ends of the fibrous strands 16 each preferably extend substantially outward from the wire core in different directions. The fibrous strands 16 may extend outward at any angle, but it is preferred that the fibrous strands 16 extend outward substantially perpendicular to the wire core, and preferably at random angles. Additionally, the fibrous strands 16 may be angled slightly upward to simulate trees such as Conifers.

The cumulative effect of the fibrous strands 16 is to form a generally cylindrical shape. Alternatively, the fibrous strands 16 may be trimmed to form a conical shape, as seen in FIG. 1. Of course, the fibrous strands 16 could also be trimmed into other shapes to simulate any different type of tree or other foliage. Preferably, the fibrous strands are of a substantially uniform diameter, and of a substantially uniform length at any point on the wire core 12.

Nevertheless, one advantage of the depicted embodiment of the miniature model trees 10 of the present invention is that the miniature model trees 10 are not perfectly uniform. The fibrous strands 16 simulating branches do not all extend straight outward from the wire core 12, and instead, extend outward at many different angles. The fibrous strands 16 are also probably not uniform in thickness, with some areas on the miniature model trees 10 thicker than others. The lengths of the fibrous strands 16 are also preferably not perfectly uniform, varying somewhat, even over the same radial cross-section of the miniature model trees 10.

A layer of paint 18 covers the fibrous strands 16. In one preferred embodiment, the layer of paint 18 is brown to further simulate branches. Mixed in with the layer of paint 18 may be glue to secure foliage materials 20 to the fibrous strands 16. Also mixed in may be detergent to assure permeation of the paint and glue and proper adherence of the layer of paint 18 and of the foliage materials 20. Of course, it is not necessary that the fibrous strands 16 are painted. For instance, the fibrous strands 16 could be flocked. Nevertheless, it is preferred that the fibrous strands 16 be painted.

A layer of material 20 simulating foliage is shown covering the fibrous strands 16. In one embodiment, the layer of material 20 comprises fine particles 20. Preferably, the fine particles 20 are layered over the layer of paint 18 and are independent of the layer of paint 18 for a more realistic effect.

As discussed, the fine particles or other foliage materials 20 are preferably bonded to the fibrous strands 16 with the layer of paint 18. The fine particles 20 are, in one embodiment, model grass, such as 785-49 Green Blend fine blended turf available from Woodland Scenics Corporation of Whitby, Ontario, Canada. The Green Blend fine blended turf comprises a finely ground foam of a light green color. Of course, any other types of materials could also be used to suitably simulate foliage.

Figure 1A:
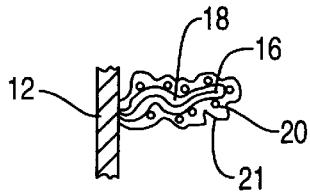
FIG. 1*a* is a partial perspective view illustrating a single fibrous strand of a miniature model tree of FIG. 1.

In an additional embodiment, shown in FIG. 1*a* , a hardening layer 21 may be applied over the fine particles 20. Under this embodiment, the hardening layer 21 may comprise a mixture of glue and water. The mixture may be, for example, one half glue and one half water. In one example, the glue comprises Elmer's Glue, as is currently available in most stores. FIG. 1*a* shows a single fibrous strand 16 wound within the wire core 12. The fibrous strand 16 is coated with a layer of paint 18 in which may be disposed detergent and glue. a layer of fine particles 20 is adhered to the layer of paint 18. A hardening layer 21 is coated over the fine particles 20 and the fibrous strand 16.

Only a single embodiment is described herein by way of example, and one of skill in the art will readily appreciate that different types of foliage materials could also be used, and that the foliage materials could be of a different fineness or color.

It is preferred that the length, density, and angle of protrusion from the wire core 12 of the fibrous strands 16 is arbitrarily selected. Thus, the size and shape of the miniature model trees 10 is arbitrary. This promotes the nonuniformity of the miniature model tree 10 and lends it a more realistic effect than existing miniature model trees 10.

Figure 2:
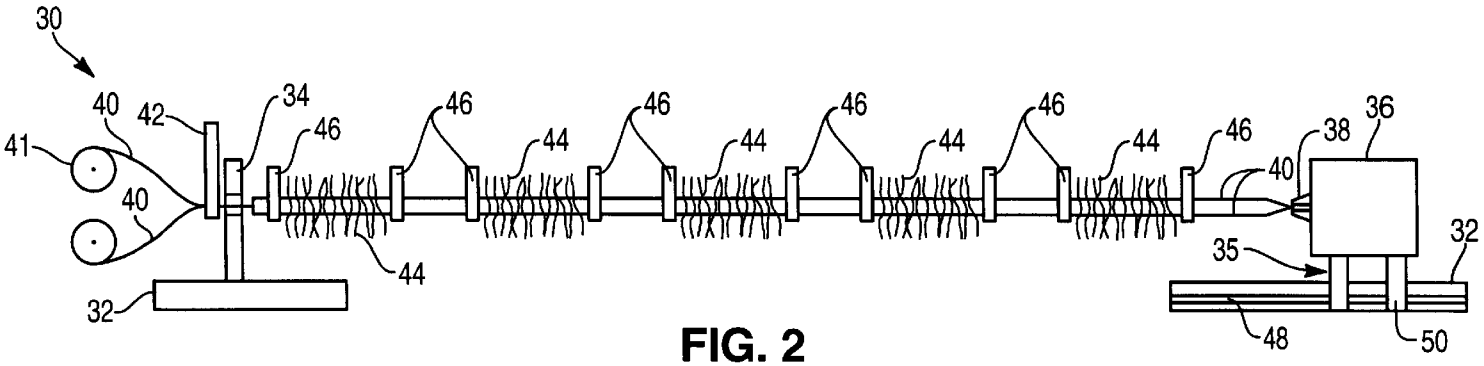
FIG. 2 is a side perspective view of a wire twisting stage of a method of the present invention.
Figure 3:
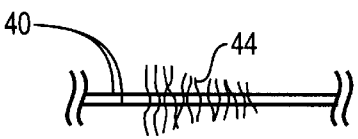
FIG. 3 is a side perspective view of a trimming operation of the method of the present invention.
Figure 4:
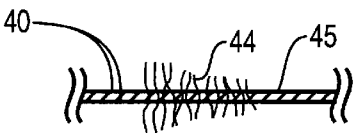
FIG. 4 shows the results of the twisting stage of FIG. 2 and the trimming operation of FIG. 3.

One method of manufacture of the miniature model trees 10 will now be described with reference to FIGS. 2 through 7. Referring now to FIG. 2, an initial step in the method is shown in which the fibrous strands 16 are twisted within the wire core 12 at a wire twisting stage 30. The wire twisting stage 30 comprises a base 32 for supporting a support member 34. The base 32 could be the ground, or a raised surface. Also shown within the wire twisting stage 30 is a rotary turning device such as a motor 36. The motor 36 is adapted for holding therein the ends of two or more wires 40. In the depicted embodiment, this is accomplished with a chuck 38.

The wires 40 are unspooled from spools 41 and pass through the hole 35 in the support brace 34 and are extended in co-unison into the chuck 38. A clamp 42 clamped on the exterior side of the support brace 34 retains the wires 40 within the support brace 34. Once within the clamp 42, the wires 40 may be cut from the spools 41.

The wires 40 are pulled taut prior to applying the clamp 42, so as to maintain a degree of tension within the wires 40, and keeping the wires 40 close together. The clamp 42 can be any suitable device providing the function of securing the ends of the wires 40 and maintaining a tension on the wires 40. In one embodiment, the clamp 42 is a pair of mechanical locking pliers. The support brace 34 could also be initially placed on its side and subsequently raised to tighten the wires 40 after applying the clamp 42.

With the wires 40 held taut between the motor 36 and the support brace 34, fibrous strands 44 are placed between the wires 40. The fibrous strands 44 are generally laid out parallel to each other and protruding substantially out at two sides from the wires 40. The distance for which the fibrous strands 44 are laid is dependent on the desired height of the finished miniature model tree 10 being formed. Likewise, the lengths of the fibrous strands 44 generally correspond to the desired width of the base of the miniature model tree 10, and the number of fibrous strands 44 corresponds to the density of the simulated branches of the miniature model tree 10.

The fibrous strands 16 can be placed within the wires 40 in an automated manner, but it is presently preferred that the fibrous strands 16 be placed manually. It is also preferred that the fibrous strands 16 be sized and arranged manually to achieve the randomness discussed above. The relatively random size, density, and placement of the fibrous strands 16 lends a more realistic appearance to the miniature model trees 10.

As discussed above, the fibrous strands 16 preferably comprise sisal or hemp. More preferably, the fibrous strands 16 comprise commonly available sisal rope, which may be two ply rope. One such brand is two-ply sisal rope available from Phoenix Rope Company of Chicago, Ill. The fibrous strands 16 are of a thickness selected to simulate branches. In one embodiment, the sisal rope is cut into segments corresponding to the desired maximum widths of the miniature model trees 10 to be produced.

The sisal rope is then untwisted to yield the individual fibrous strands 16 of which it is formed. These individual fibrous strands 16 are then placed within the wires 40, as discussed above. Providing fibrous strands 16 from unwound rope gives the fibrous strands different bends, angles, and a general nonuniformity.

Once the fibrous strands 16 are arranged between the wires 40, clamps 46 are placed on the wires 40 to keep the fibrous strands 16 in place, and to define the simulated trunks of the miniature model trees 10. The clamps 46 are placed at least at either end of the fibrous strands 16, as shown. Additional clamps 46 may also be placed in the trunk region that is devoid of fibrous strands 16. In one embodiment, the clamps 46 comprise alligator clips.

Figure 2A:
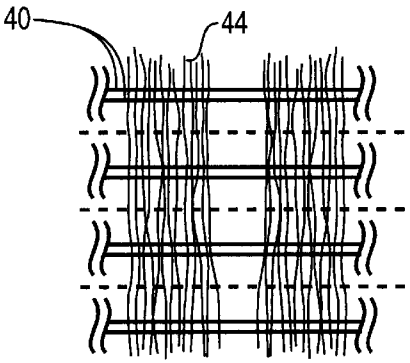
FIG. 2*a* is a top view of an alternate embodiment of a wire twisting stage of the method of the present invention.

FIG. 2*a* depicts a further contemplated embodiment of the wire twisting stage 30 of the present invention. In FIG. 2, ends of multiple sets of wires 40 are each held within a separate adjacent rotary turning devices such as the motor 36. Opposite the rotary turning devices are a plurality of support braces (not shown) and clamps 42 holding the other ends of the wires 40. The sets of wires 40 are arranged parallel to each other and are separated by distances corresponding to the desired width of the resulting miniature model trees 10. The fibrous strands are cut into appropriate lengths to span the cumulative sets of wires 40 with the edges thereof protruding.

Cuts are then made in the fibrous strands at approximately the positions shown by the dashed lines of FIG. 2*a*. In this manner, several lines of wires 40 can be loaded with fibrous strands 16 at any one time in order to manufacture the miniature model trees 10 in greater volumes.

Once the clamps 46 are in place, the fibrous strands 16 are trimmed to simulate the shape of a tree. In the depicted embodiment of FIG. 3, the fibrous strands 44 are shown trimmed into a triangular shape to simulate a pine tree. At this point in the method, the fibrous strands are arranged in a substantially planar arrangement, rendering the task of trimming and shaping the fibrous strands 44 easier.

Once the fibrous strands 16 are trimmed into the desired shape, a clear laminate such as laquer is applied over the wires 40 and the fibrous strands 16. The laminate keeps the wires 40 together and helps retain the fibrous strands 16 within the wires 40. The clear laminate may also comprise a glue and water mixture. In one embodiment, a mixture of one half Elmer's Glue and one half water is used. In other embodiments, the clear laminate may not be applied until foliage is applied, as will be discussed.

In a further step, the wires 40 are twisted into a mutually spiraling arrangement in which the wires spiral around each other. To do so, the motor 36 is engaged. The chuck 38, which may be attached to a central shaft of the motor 36 spins, causing the wires 40 to spiral around each other. In order to keep the wires 40 from snapping under excess tension, the motor 36 is dynamically mounted to the base 32. Thus, as the wires 40 spiral and shorten, they pull the motor 36 forward. The motor 36 is mounted with an amount of resistance selected to keep the wires 40 taut.

In the depicted embodiment, the motor 36 rides within slots 48 on either side of the base 32. Spurs 50 in a stand 35 of the motor 36 protrude into the grooves 48 providing the proper linear direction of travel of the motor 36. The friction between the spurs 50 and the grooves 48 is preferably adjustable to exert the proper amount of resistance to the forward motion of the motor to keep the wires 40 taut.

Figure 5:
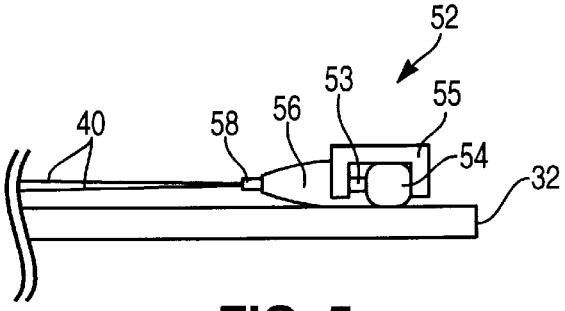
FIG. 5 is a perspective view of an alternate embodiment of the wire twisting stage of FIG. 2.

A further embodiment of a rotary turning device is shown in FIG. 5. Seen therein is a rotary power mill such as a hand drill 52. The hand drill 52 is comprised of a body 56 and a handle 54. A trigger 53 protrudes outward from the handle 53. The hand drill 52 may be merely lain on the base 32 and engaged, allowing the drill 52 to move forward freely as it twists and winds the wires 40. The weight of the drill 52 provides the proper amount of resistance to keep the wires 40 taut. A clamp 55 is shown holding the trigger 53 in the engaged position. The trigger 53 may also be engaged manually.

As the wires 40 twist, the fibrous strands 16 become entwined between the coils of the wires 40. The fibrous strands 16 are also distributed throughout the coils automatically by their original random placement discussed above. Accordingly, as the wires 40 twist into a spiral arrangement, the fibrous strands 16 begin to protrude substantially radially outward from the twisted wires 40 in a 360 degree range. Thus, the originally planar fibrous strands 16 become, through the twisting of the wires 40, substantially conical in shape, more accurately simulating the branches of a tree. The twisting of the wires 40 forms the wires 40 into a single wire core shown at 45 in FIG. 3, seen at 12 in FIG. 1.

Figure 6:
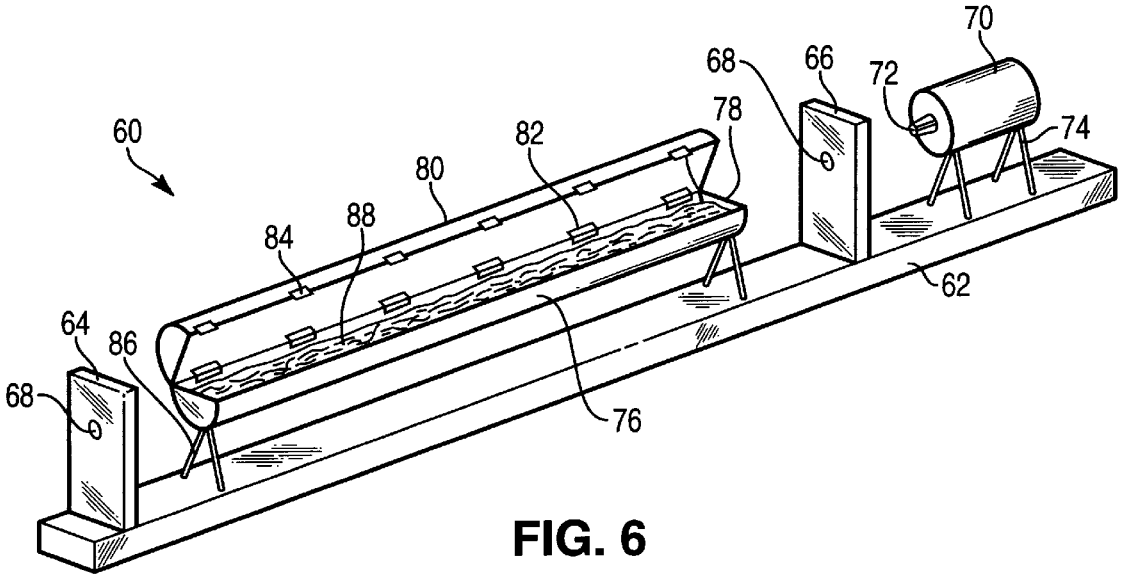
FIG. 6 is a top perspective view of a paint application stage of a method of the present invention.

FIG. 6 shows a paint application stage 60. Seen therein is a base 62 upon which the components of the paint application stage 60 rest. Once again, the base 62 could be the ground or a raised surface. Support braces 64 and 66 are used to support the wire core 45 within holes 68 therein. The second support base 66 could be omitted. A rotary turning device is again provided, such as a motor 70. The depicted motor 70 is shown provided with a chuck 72 as one example of a device for retaining an end of the wire core 45.

The motor 70 is supported above the base 62 with a stand 74. Between the support braces 64, 66 is shown an elongated tubular tank 76. The tank 76 is split into two sections, a well 78 and a lid 80. The well 78 and lid 80 are connected by hinges 82 and are fastenable together to form a substantially sealed enclosure therein with latches 84. The tank 76 is held above the base 62 with stands 86. Within the well 78 is a pool of paint 88.

After the formation of the wire core 45 at the wire twisting stage 30, the wire core 45 with attendant conical groups of trimmed fibrous strands 16 is removed from the wire twisting stage and held above the tank 76. With the lid 80 open, the wire core 45 is lowered into the well 78 to submerge the wire core 45 and fibrous strands 44 in the paint 18. The wire core 45 and fibrous strands 44 may be spun around slowly while in contact with the paint 18.

The wire core 45 with the fibrous strands 44 thereon is subsequently removed from the paint 18 and the excess paint spun off. In one embodiment, this comprises merely raising the wire core 45 and fibrous strands 44 within the tank 76 and spinning the wire core 45.

Alternatively, the ends of the wire core 45 are passed through the support braces 64, 66. A clamp is applied at one end of the wire core 45 and the other end is placed within the chuck 72 in much the same manner as described above for the wire twisting stage 30. The lid 80 is then closed and latched, enclosing the wire core 45 and fibrous strands 44 within the interior of the tank 76.

The motor 70 or other rotary turning device is then engaged, spinning the wire core 45 and fibrous strands 44. The spinning is conducted at a sufficiently high RPM to create a centrifugal force that spins the excess paint 88 from the fibrous strands 44. In one embodiment, the spinning is conducted at about 1500 RPM for a time period of about two seconds.

Once the excess paint has been removed, the wire core 45 is removed from the paint application stage 60 and moved to a foliage application stage.

Figure 7:
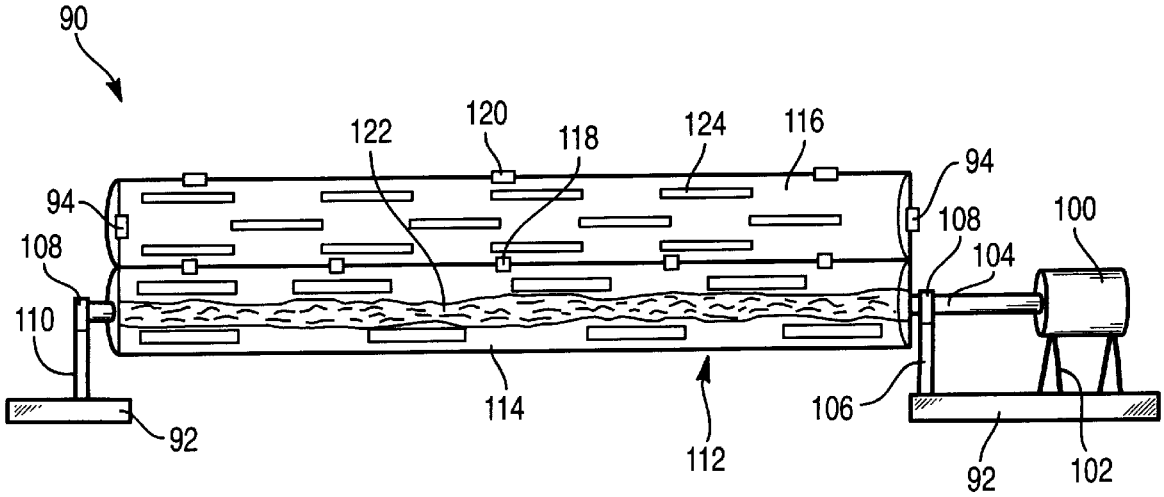
FIG. 7 is a side perspective view of a foliage application stage of the method of the present invention.

FIG. 7 shows one embodiment of a foliage application stage 90. Within the foliage application stage 90 is seen a base 92 upon which the components of the foliage application stage 90 rest. Once again, the base 92 could be the ground or a raised surface.

A rotary turning device such as a motor 100 is also provided. The depicted motor 100 is supported upon the base 92 with a stand 102. A drive shaft 104 is driven by the motor 100 and is connected to a foliage application tank 112. Support rests 106, 110 are provided with bearings 108 for supporting the distal ends of the tank 112. The tank 112 is allowed to turn within the bearings 108 upon application of rotational force by the motor 100 through the drive shaft 104.

Figure 8:
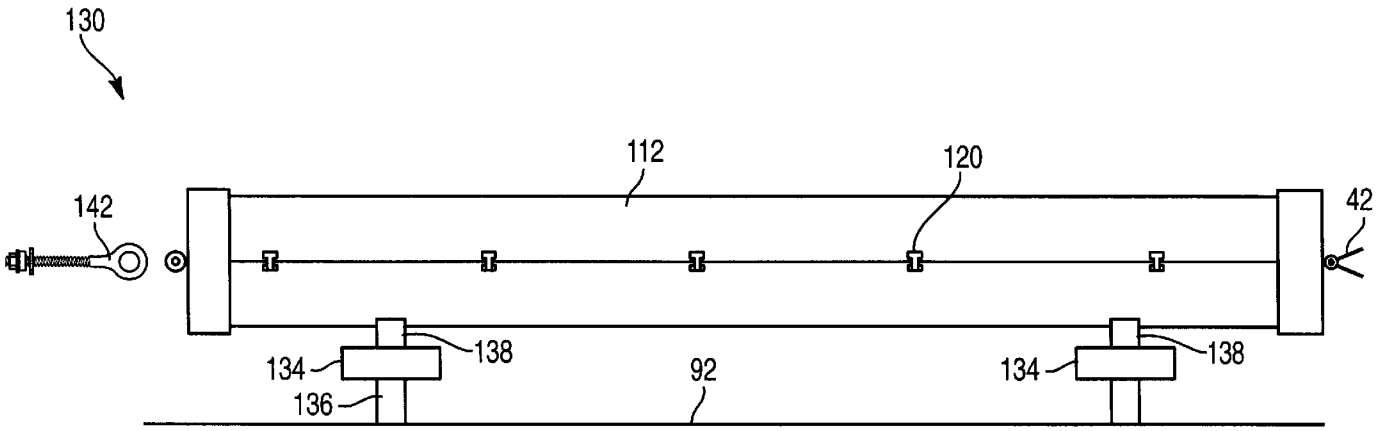
FIG. 8 is a side perspective view of an alternate embodiment of the foliage application stage of FIG. 7.
Figure 10:
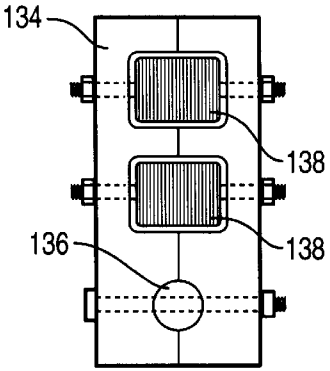
FIG. 10 is a top perspective view of a base and rollers of the foliage application stage of FIGS. 8 and 9.
Figure 9:
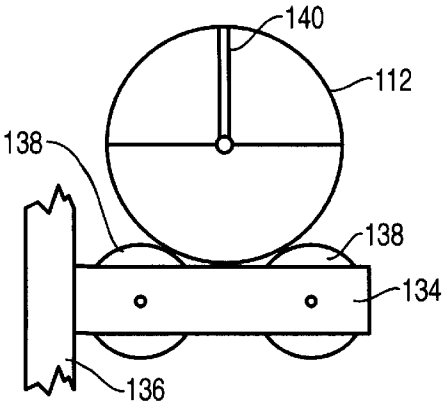
FIG. 9 is a side perspective view of the foliage application stage of FIG. 8.

Shown in FIG. 8 is an alternate embodiment of an application stage 130. In embodiment of 130, the foliage application tank 112 rides upon a support base 134. The support base 134 has a stand 136 supported upon the base 92. Within the support stand 134 are mounted a pair of skateboard wheels 138 as shown in FIGS. 9 and 10. The foliage application tank 112 rides upon the skateboard wheels 138 as shown in FIG. 9 and may be turned by hand or using a rotary turning device such as the motor 100 of FIG. 7.

Figure 11:
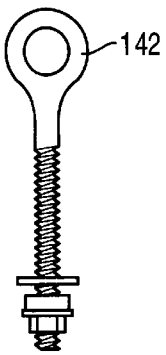
FIG. 11 is a side perspective view of a rotating eye bolt of the present invention.

FIG. 10 is a top view of the support base 134 and skateboard wheels 138. FIG. 11 shows a rotating eye bolt 142 which may be used in any of the above stages to fasten one end of the wire thereto. In the further embodiment, the chucks 72, 38 of FIGS. 2 and 6 may be provided with an eye bolt fixed therein for quickly fastening the wires 40 thereto.

Referring again to FIG. 7, the tank 112 is provided with a well 114 and a lid 116. The lid 116 is connected to the well 114, with a plurality of hinges 118. A plurality of latches 120 allow the lid 116 to secure to the well 114, defining a substantially enclosed interior therein. Clips 94 are provided within the lid 116 or the well 114 for connecting to the ends of the wire core 45 to suspend the wire core 45 within the interior of the tank 112.

Within the well 114 and the lid 116 are arranged elongated fins 124. The elongated are in one embodiment about an inch high, about a half inch wide, and about eight inches to a foot long. The fins 124 are distributed throughout the well 114 and the lid 116.

A quantity of fine particles 122, such as the fine particles 20 discussed above, is placed within the well 114. The fine particles 122 are distributed across the bottom of the well 114, in a sufficient amount to fully coat all of the fibrous strands 44 on the wire core 45, once applied thereto.

The wire core 45 is positioned between the well 114 and the lid 116, with the ends of the wire core 45 passed through the holes 98 of the support stands 94, 96. Clamps such as the clamp 42 of FIG. 2 are then clamped to the ends of the wire core 45 to retain the wire core between the support stands 94, 96 and between the well 114 and the lid 116. The lid 116 is then closed, enclosing the wire core 45 and attached fibrous strands 44 within the tank 112. The motor 100 is then engaged, causing the tank 112 to spin. The spinning of the tank 112 causes the fine particles 122 to be dispersed and tumbled within the tank 112. The wire core 45 with the fibrous strands 44 may be stationary or may spin with the tank 112. Under this arrangement, the fine particles 122 come to coat the fibrous strands 44.

Once the fibrous strands 44 are substantially coated with the fine particles 122, the wire core 45 and attendant fibrous strands 44 are removed from the foliage application stage 90 and allowed to partially dry. The paint 88 together with the glue and detergent therein adheres the fine particles 122 to the fibrous strands 44.

In a further step, a hardening layer 21 is preferably applied over the fibrous strands 44 to further adhere the fine particles 122 thereto and to assist the trees 10 in maintaining their shape. The hardening layer 21 may be applied while the paint is partially or fully dry. The hardening layer 21 may comprise laquer. In a presently preferred embodiment, the hardening layer 21 comprises a mixture of glue and water. Under this embodiment, the glue comprises Elmer's Glue, and is mixed in a 1:1 ratio with water.

Once the paint is dry and the hardening layer has been applied, the wire core 45 is cut into individual tree segments, such that a plurality of miniature model trees such as the miniature model trees 10 of FIG. 1 are formed. The miniature model trees 10 may be trimmed again at this point.

In one embodiment, the trunk portions of the wire cores 12 of each of the resulting miniature model trees 10 are wrapped in an adhesive tape such as the adhesive tape 14 of FIG. 1. Preferably, as discussed above, the adhesive tape comprises brown florist's tape. One brand of Florist's Tape is Floratape, available from Floral Products Co. of Neenah, Wis.

After the adhesive tape 14 is applied, the thusly formed miniature model trees 10 are packaged for distribution. Due to the protective hardening layer 21, the model trees 10 may be packaged within a common open box without significantly damaging the model trees 10.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A method of making miniature model trees for use in creating and replicating scenery, the method comprising the steps of:

suspending a plurality of wires substantially in tension;

placing a plurality of fibrous strands within the plurality of wires with the strands protruding substantially laterally outward from the plurality of wires;

forming a trunk by twisting the plurality of wires together such that the wires form coils with the fibrous strands substantially dispersed within the coils, the fibrous strands extending outward from the coils to simulate branches;

adhering a layer of paint to the fibrous strands;

adhering a coating of fine particles to the branches while the paint is still wet; and adhering a hardening layer over the coating of fine particles.

2. The method of claim 1, further comprising adhering a layer of clear laquer to the branches prior to adhering a layer of paint to the fibrous strands.

3. The method of claim 1, further comprising mixing glue into the paint prior to adhering a layer of paint to the fibrous strands.

4. The method of claim 1, wherein the fine particles comprise model grass.

5. The method of claim 1, wherein the wires are sufficiently long to form a plurality of model trees therefrom, and further comprising placing fibrous strands within the plurality of wires at a plurality of locations prior to the step of forming a trunk, so as to form a plurality of trees within the plurality of wires.

6. The method of claim 1, further comprising placing the paint in the bottom of an elongated tube, and placing the plurality of wires within the elongated tube prior to adhering a layer of paint.

7. The method of claim 1, wherein the coating of fine particles is contained within an elongated tube, and wherein the step of adhering the coating of fine particles is conducted with the plurality of wires extending through the center of the elongated tube.

8. The method of claim 1, further comprising arbitrarily selecting the length of the fibrous strands and arbitrarily selecting the dispersion of the fibrous strands within the wires during the step of placing a plurality of fibrous strands within the wires.

9. The method of claim 1, further comprising cutting a strand of hemp rope and unraveling the strand of hemp rope in order to provide the fibrous strands.

10. The method of claim 1, wherein the layer of paint adhered to the branches is substantially a brown shade and the fine particles are substantially a green shade so as to give the miniature trees a random, two-toned appearance.

11. The method of claim 1, further comprising providing a rotary power mill and clamping one end of the plurality of wires within the rotary power mill, the rotary power mill dynamically positioned so as to be able to move forward during the step of forming a trunk so as to maintain a substantially constant tension on the plurality of wires.

12. The method of claim 1, further comprising wrapping a portion of the bottom of the trunk in an adhesion tape.

13. The product formed by the process of claim 1.

* * * * *